US008416980B2

(12) United States Patent
Kang

(10) Patent No.: US 8,416,980 B2
(45) Date of Patent: Apr. 9, 2013

(54) SENSORY SIGNAL OUTPUT APPARATUS

(75) Inventor: Yun Gyu Kang, Bucheon-si (KR)

(73) Assignee: Yea Il Electronics Co., Ltd., Incheon (KR)

( * ) Notice: Subject to any disclaimer, the term of this patent is extended or adjusted under 35 U.S.C. 154(b) by 0 days.

(21) Appl. No.: 13/265,469

(22) PCT Filed: Jun. 4, 2009

(86) PCT No.: PCT/KR2009/002984
§ 371 (c)(1),
(2), (4) Date: Oct. 20, 2011

(87) PCT Pub. No.: WO2010/123169
PCT Pub. Date: Oct. 28, 2010

(65) Prior Publication Data

US 2012/0033849 A1 Feb. 9, 2012

(30) Foreign Application Priority Data

Apr. 22, 2009 (KR) ..... 10-2009-0035133

(51) Int. Cl.
*H04R 25/00* (2006.01)

(52) U.S. Cl.
USPC ..... 381/412; 381/396; 381/431

(58) Field of Classification Search ..... 381/396, 381/412–413, 417–418, 421, 431, 433
See application file for complete search history.

(56) References Cited

U.S. PATENT DOCUMENTS

| | | | | |
|---|---|---|---|---|
| 6,466,682 | B2 | 10/2002 | An | |
| 6,621,911 | B2 | 9/2003 | Kobayashi et al. | |
| 6,807,282 | B2 * | 10/2004 | Kaneda et al. | 381/396 |
| 2005/0285454 | A1 | 12/2005 | Choi et al. | |
| 2006/0266967 | A1 | 11/2006 | Miura | |
| 2007/0236088 | A1 | 10/2007 | Miura | |

FOREIGN PATENT DOCUMENTS

| | | | |
|---|---|---|---|
| KR | 100842092 | B1 | 6/2008 |
| KR | 100842093 | B1 | 6/2008 |

* cited by examiner

*Primary Examiner* — Suhan Ni
(74) *Attorney, Agent, or Firm* — Novick, Kim & Lee, PLLC; Jae Youn Kim

(57) ABSTRACT

A sensory signal output apparatus is provided. The sensory signal output apparatus, includes: a magnetic circuit vibrating in response to an alternating signal flowing through a coil; and an elastic support means elastically supporting the magnetic circuit to surround the circumferential outer surface of the magnetic circuit from one side direction thereof, in which coupling recesses are formed at the circumferential outer surface of the magnetic circuit to be spaced apart from each other, and a coupling piece is provided at a periphery of the elastic support means to be coupled to the coupling recess, the coupling piece is attached to and inserted into the coupling recess. In the sensory signal output apparatus, an elastic support means is inserted into and coupled to a magnetic circuit without using a curling operation to provide easy coupling.

13 Claims, 10 Drawing Sheets

SENSORY SIGNAL OUTPUT APPARATUS

BACKGROUND OF THE INVENTION

1. Field of the Invention

The present invention relates to a sensory signal output apparatus for outputting vibration, sounds, or both of them.

2. Description of the Related Art

As well known to those skilled in the art, a sensory signal output apparatus is an apparatus outputting voices or vibrating force such as a speaker, a receiver, a buzzer, or vibrator which converts an electric signal, input from a signal source, into a mechanical signal to output sounds or generate vibration.

As shown in FIG. 1, in a conventional sensory signal output apparatus, the magnetic circuit 1 a magnetic circuit 1 including a yoke 2, a magnet 3, and a top plate 4 responds to a magnetic flux formed at an aperture depending on a direction of an alternating signal input to a coil 6 located at an opening between the yoke 2, the magnet 3, and the top plate 4, and vibrates to generate vibrating force and/or sounds. In this case, the magnet 3 and the top plate 4 are sequentially stacked and fixed to an upper surface of the yoke 2 through adhering or welding.

The magnetic circuit 1 is provided with a weight member 5 to enhance vibrating force. At this time, the weight member 5 is substantially located in an outward direction of the magnetic circuit 1. Further, the magnetic circuit 1 is supported in a case 1*a* through a plate spring 7. A support member is cut to form a spring at a side of the plate spring 7, and another side of the plate spring 7 annularly protrudes to surround and fix the circumferential outer surface of the magnetic circuit 1.

An annular protrusion end of the plate spring 7 is bent through a curling device to attach and fix the magnetic circuit 1.

However, in the conventional sensory signal output apparatus, because the plate spring 7 is fixedly coupled to the magnetic circuit 1 by bending and attaching a front end (part "A" of FIG. 1) of the plate spring 7 in a direction of the magnetic circuit 1 through a separate curling device, fixing force may be improved and an aesthetical outward appearance may maintain (without using adhesive material). However, because easy coupling is not achieved, there is a problem in that the workability and productivity are low.

Further, in the conventional sensory signal output apparatus, because an annular end of the plate spring 7 surrounds and fixes the circumferential outer surface of the magnetic circuit 1, there is a problem in that a diameter of the magnetic circuit 1 become shorter corresponding to the thickness of the plate spring 7 to make a weight light. This leads to a reduction in the vibrating force and a reduction in a middle-low sound characteristic.

When the diameter of the magnetic circuit 1 becomes shorter, a weight thereof becomes lighter and it is restricted by the size of a magnet to restrict the security of magnetic force.

So as to solve the problem, the diameter of the magnetic circuit 1 should be increased. This results in an increase of the total size of the sensory signal output apparatus, which runs counter to the miniaturized trend of electronic parts business being in the.

Since sound output relation parts such as the sensory signal output apparatus of the present invention and electric/electronic products of an applied thereto are small-sized, the sizes thereof become small inevitably. In this case, the small size (the size of small fingernail) cannot provide a weight associated with vibration easily. An index of a technical power is to secure a weight and magnetic force associated with vibration capable of obtaining the same output characteristics in a state that the total size (diameter) of the sensory signal output apparatus is reduced or is not increased.

SUMMARY OF THE INVENTION

Accordingly, the present invention has been made keeping in mind the above problems occurring in the prior art, and provides a sensory signal output apparatus.

In order to accomplish the above object, the present invention provides a sensory signal output apparatus, including: a magnetic circuit vibrating in response to an alternating signal flowing through a coil; and an elastic support means elastically supporting the magnetic circuit to surround the circumferential outer surface of the magnetic circuit from one side direction thereof, in which coupling recesses are formed at the circumferential outer surface of the magnetic circuit to be spaced apart from each other, and a coupling piece is provided at a periphery of the elastic support means to be coupled to each of the coupling recesses, the coupling piece is attached to and inserted into the coupling recess.

In the present invention, an elastic support means is inserted into and coupled to a magnetic circuit without using a curling operation to provide easy coupling. Furthermore, the present invention may maximize a weight and the size of a magnet in a magnetic circuit having the same diameter and height to improve vibrating force and middle-low sound characteristics.

BRIEF DESCRIPTION OF THE DRAWINGS

The objects, features and advantages of the present invention will be more apparent from the following detailed description in conjunction with the accompanying drawings, in which.

DETAILED DESCRIPTION OF EXEMPLARY EMBODIMENTS

Figure 1:
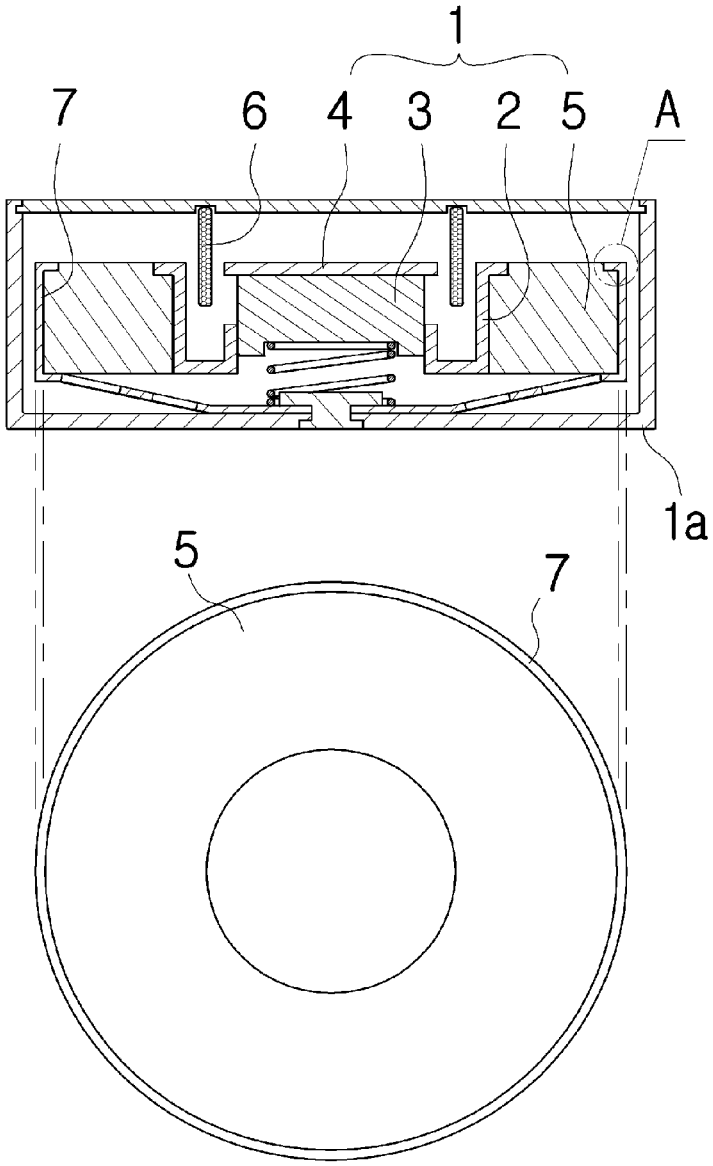
PRIOR ART Fig. 1
FIG. 1 is a cross-sectional view and a plan view illustrating a configuration of a conventional sound output apparatus.
Figure 2:
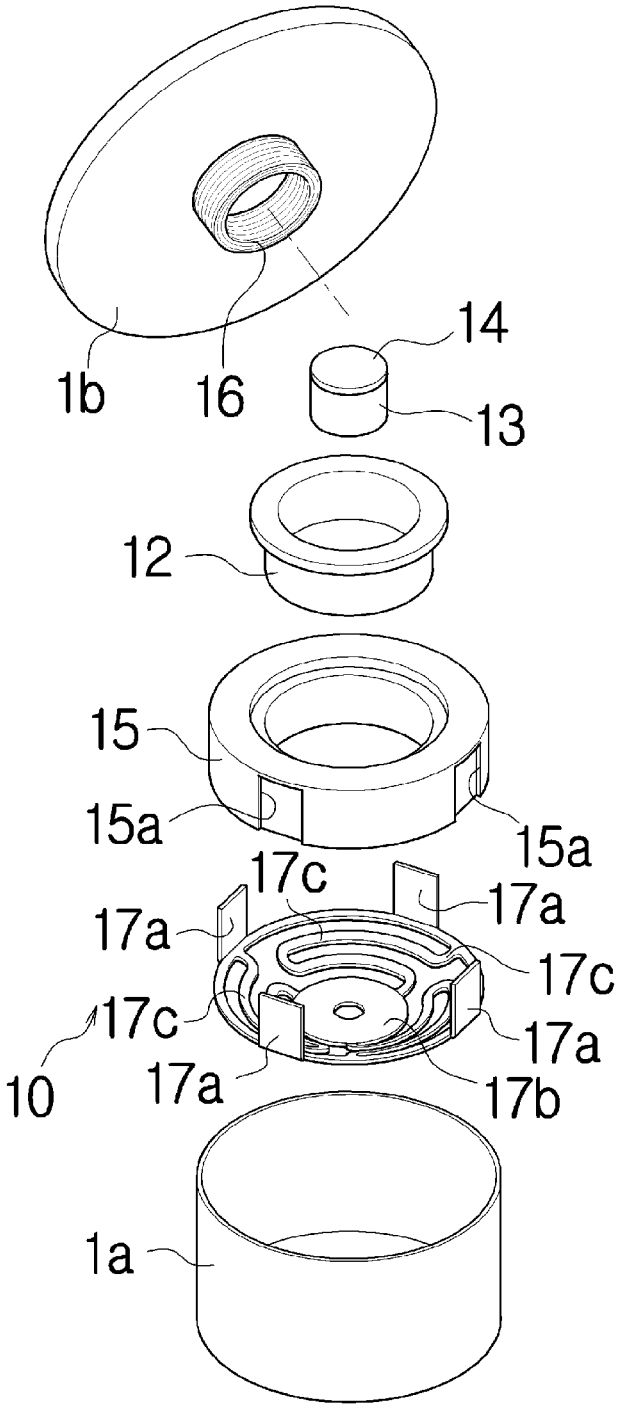
FIG. 2 is an exploded perspective view illustrating a configuration of a sensory signal output apparatus according to an embodiment of the present invention.
Figure 3:
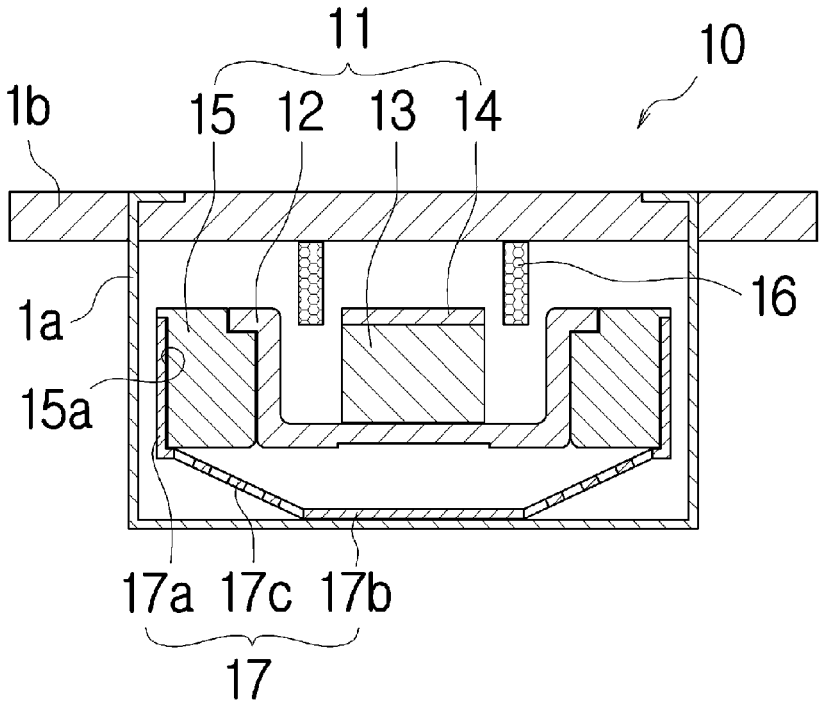
FIG. 3 is a cross-sectional view illustrating the sensory signal output apparatus shown in FIG. 2.
Figure 4:
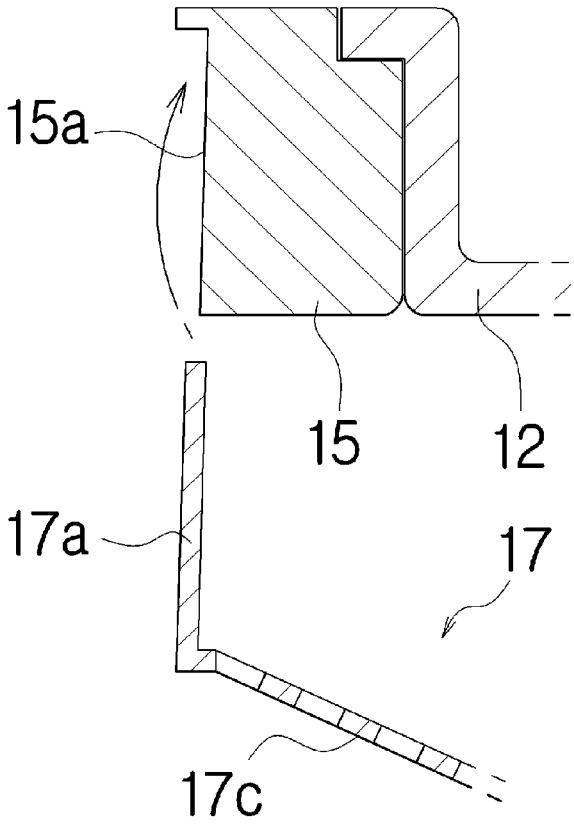
FIG. 4 is a cross-sectional view illustrating an example of a coupling structure of a magnetic circuit and an elastic support means according to an embodiment of the present invention.
Figure 5:
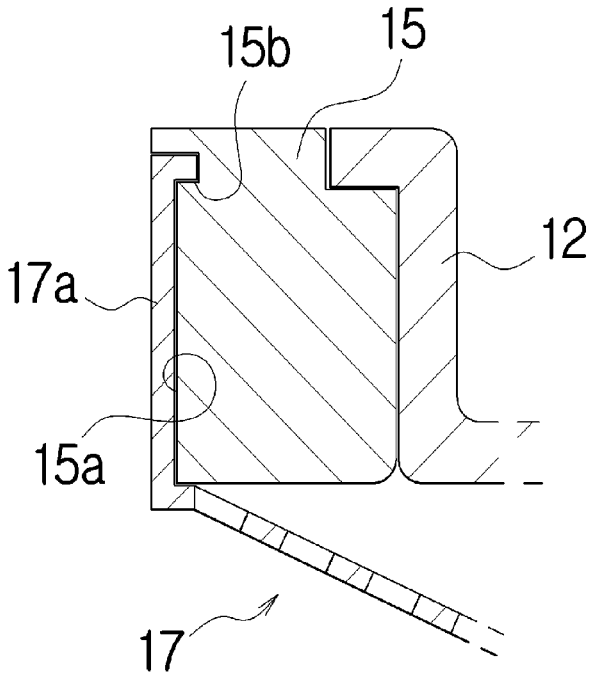
FIGS. 5 and 6 are cross-sectional views illustrating other examples of a coupling structure of a magnetic circuit and an elastic support means according to an embodiment of the present invention.
Figure 6:
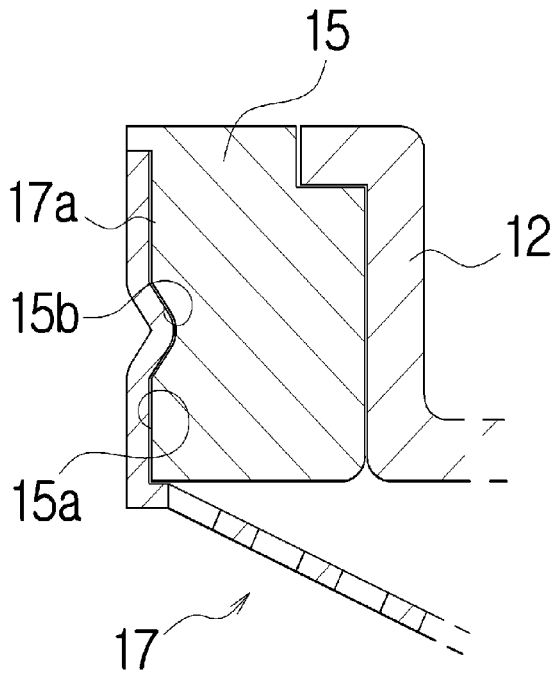
Figure 7:
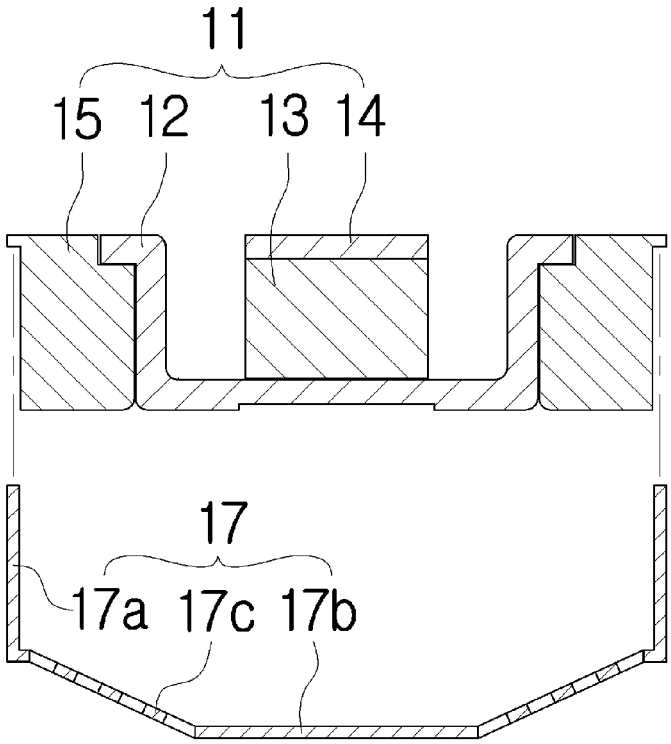
FIG. 7 is an exploded perspective view illustrating a coupled state of a magnetic circuit and an elastic support means according to an embodiment of the present invention.
Figure 8:
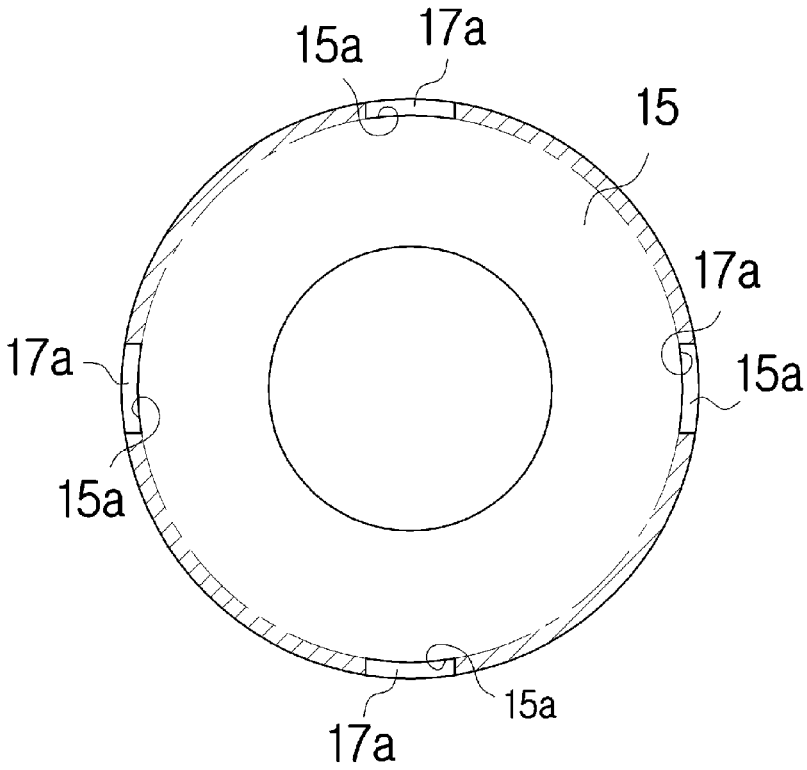
FIG. 8 is a plan view illustrating a confirmed state in a volume of a weight member according to an embodiment of the present invention.
Figure 9:
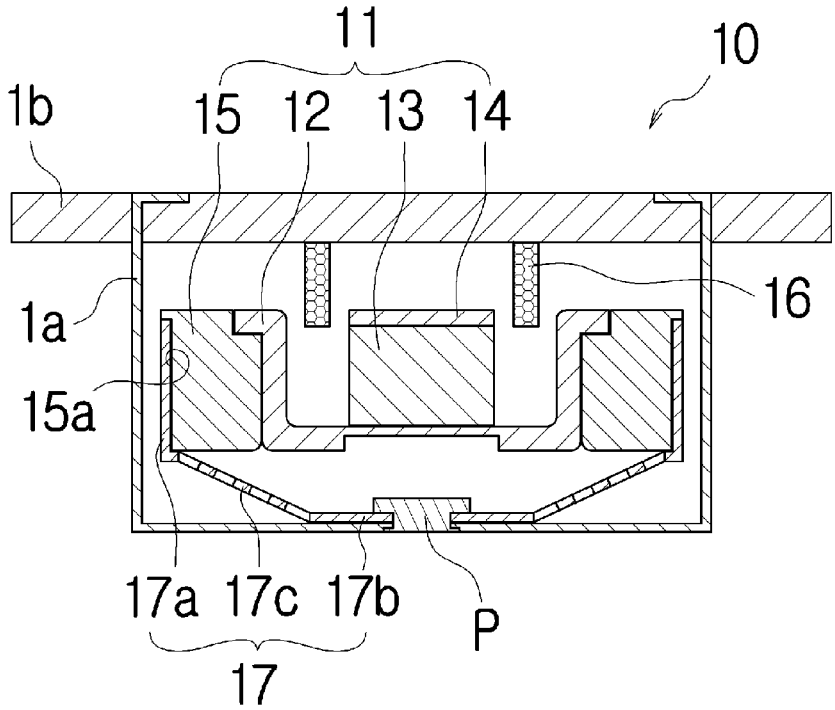
FIGS. 9 and 10 are views illustrating examples of coupling of an elastic support means to a case according to an embodiment of the present invention.
Figure 10:
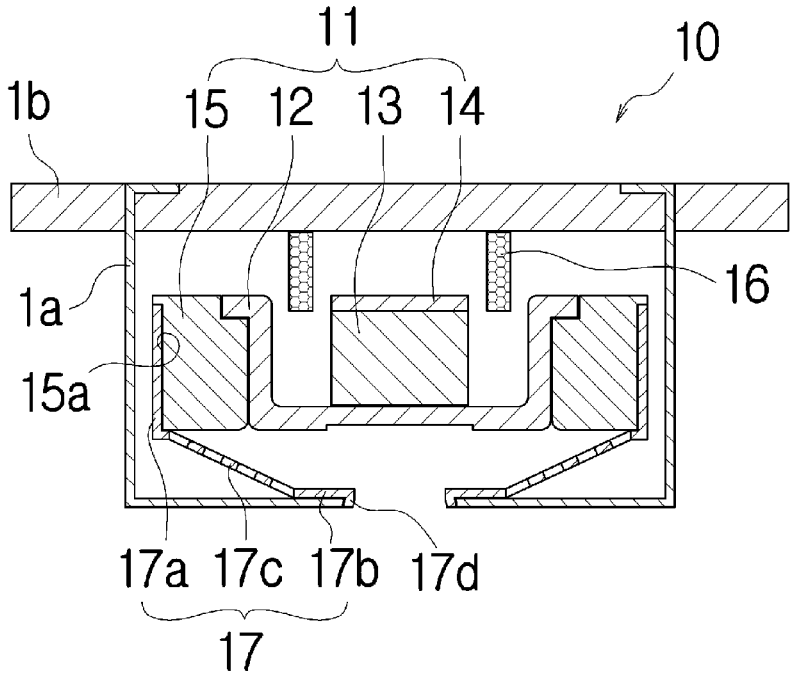

FIG. 2 is an exploded perspective view illustrating a configuration of a sensory signal output apparatus according to an embodiment of the present invention, FIG. 3 is a cross-sectional view illustrating the sensory signal output apparatus shown in FIG. 2, FIG. 4 is a cross-sectional view illustrating an example of a coupling structure of a magnetic circuit and an elastic support means according to an embodiment of the present invention, FIGS. 5 and 6 are cross-sectional views illustrating other examples of a coupling structure of a magnetic circuit and an elastic support means according to an embodiment of the present invention, FIG. 7 is an exploded perspective view illustrating a coupled state of a magnetic circuit and an elastic support means according to an embodiment of the present invention, FIG. 8 is a plan view illustrating a confirmed state in a volume of a weight member according to an embodiment of the present invention, and FIGS. 9 and 10 are views illustrating examples of coupling of an elastic support means to a case according to an embodiment of the present invention.

Exemplary embodiments of the present invention are described with reference to the accompanying drawings in detail. The same reference numbers are used throughout the drawings to refer to the same or like parts. Detailed descriptions of well-known functions and structures incorporated herein may be omitted to avoid obscuring the subject matter of the present invention.

Referring to FIG. 2 to FIG. 4, a sensory signal output apparatus 10 according to the present invention includes a magnetic circuit 11 vibrating in response to an alternating signal flowing through a coil 16; and an elastic support means 17 elastically supporting the magnetic circuit 11 to surround the circumferential outer surface of the magnetic circuit 11 from one side direction thereof, in which coupling recesses 15*a* are formed at the circumferential outer surface of the magnetic circuit 11 to be spaced apart from each other, and a coupling piece 17*a* is provided at a periphery of the elastic support means 17 to be coupled to each of the coupling recesses 15*a*.

In this case, the coupling piece 17*a* may be tightly inserted into and coupled to the coupling recess 15*a* according to physical and mechanical properties in materials (hard metal materials having elasticity) of the elastic support means 17, and the coupling recess 15*a* and the coupling piece 17*a* may be welded and adhered to each other in this case.

The magnetic circuit 11 may include a magnet 13 generating magnetic force; a top plate 14 disposed and fixed to an upper surface of the magnet 13; a yoke 12 including an annular protrusion formed in a through hole in a central portion thereof, inserted into and coupled to a circumferential outer surface of an end of the magnet 13, a side end of the annular protrusion extending and bent facing a circumferential outer surface of the magnet 13 to form an aperture, and an end of the annular protrusion bent in a free space; and a weight member 15 attached to and inserted into a circumferential outer surface of the yoke 12, the coupling recess 15*a* being formed at a circumferential outer surface of the weight member 15, and an inner annular protrusion 15*b* corresponding to the end of the yoke 12 bent in the free space being formed at an inner diameter of an upper portion of the weight member 15.

An annular magnet 13 and a weight member 15 may be stacked, inserted into and coupled to the circumferential outer surface of the yoke 12 to reduce a weight and compensate for the reduced weight through magnetic force. In this case, the coupling recess 15*a* may also be formed at an annular circumferential outer surface of the magnet 13.

The foregoing embodiment has illustrated that the coupling recess 15*a* is formed at the circumferential outer surface of the weight member 15. However, the present invention is not limited thereto. That is, all recesses provided at a structural element located at an outer part of structural elements constituting the magnetic circuit 11 and performing the foregoing function are used for the coupling recess 15*a*.

As illustrated previously, the arrangement of respective structural elements in the magnetic circuit 11 may be changed according to the purpose of the user (control output characteristics through increasing and reducing weight or magnetic force). As illustrated earlier, if the magnetic circuit 11 has a coupling recess 15*a* coupled to the coupling piece 17*a* of the elastic support means 17, it is regarded as a right of the present invention.

From this point of view, the coupling recess 15*a* is provided at the weight member 15 of the magnetic circuit by way of example in an embodiment of the present invention. However, since certain structural elements may be arranged at an outer part of the magnetic circuit (both of the magnet and the yoke may be arranged at an outer part), all parts provided at the coupling recesses 15*a* will be generally described as the magnetic circuit 11.

Further, the weight member 15 is a weight body without magnetism, and may be made of tungsten, tungsten alloy or other metal materials.

Meanwhile, the coil 16 is a circularly wound coil in which flow of an electric current changes according to an alternating current signal provided from an external signal supply source. In this case, the coil 16 is adhered and fixed to a center of one side of a cover 1*b* blocking an opening portion of a case 1*a* having a box shape receiving the magnetic circuit 11 and the elastic support means 17, and one end of the coil 16 may be located at an aperture between the yoke 12 and the magnet 13.

In the meantime, the elastic support means 17 may be a plate spring that extends from an inner bottom surface of the case 1*a* to an open direction to have a horn shape, and the inclined extending surface thereof is cut, which applies elastic force.

In this case, the elastic support means 17 may include a fixing surface 17*b* provided at a central portion thereof; an elastic body 17*c* formed by cutting and bending the inclined extend surface; and coupling pieces 17*a* vertically protruding from a part of a circumferential outer surface of the elastic body 17*c* to be spaced apart from each other by a predetermined distance.

In this case, the coupling piece 17*a* may extend from an outer part in which the elastic body 17*c* is located, and the number of the coupling pieces 17*a* is not limited specially. As shown, four coupling pieces 17*a* are applied in an embodiment of the present invention in consideration of the center of mass. When the coupling piece 17*a* extends from an outer part in which the elastic body 17*c* is located, the number of the coupling pieces 17*a* depends on the number of the elastic bodies 17*c*.

Moreover, a front end of the coupling piece 17*a* may be vertically provided. However, referring to FIG. 4, the coupling piece 17*a* may be included in an inward direction of the elastic support means 17. At that time, when the elastic support means 17 is coupled to the magnetic circuit 11, a front end of the coupling piece 17*a* of the elastic support means 17 may elastically restrict the coupling recess 15*a* part of the magnetic circuit 11 to make it possible to be separated without requiring a separate fixing operation.

As shown in FIG. 5, a front end of the coupling piece 17*a* is bent inwards to further form a corresponding locking recess 15*b* in the coupling recess 15*a* of the magnetic circuit 11.

As shown in FIG. 6, a central part of the coupling piece 17*a* is bent inwards to further form a corresponding locking recess 15*b* in a central part of the coupling recess 15*a* of the magnetic circuit 11.

It is preferred that the coupling recess 15 and the coupling piece 17*a* of the present invention have the same width and thickness. It is preferred that an interval of a corresponding coupling recess 15*a* is less than that of a corresponding coupling piece 17*a* in consideration of compression force of the coupling piece 17*a* for the coupling recess 15*a*. If doing it, the coupling force of the coupling piece 17*a* with the coupling recess 15*a* is increased.

Further, the elastic support means 17 may be welded or adhered to an inner bottom surface of the case 1*a*.

As shown in FIG. 7, in the present invention constructed as illustrated, the magnetic circuit 11 and the elastic support means 17 are coupled to each other by insertion and attaching to achieve easy coupling.

That is, if the coupling piece 17*a* of the elastic support means 17 is pushed out of the coupling recess 15*a* of the magnetic circuit 11, the coupling piece 17*a* elastically presses the coupling recess 15*a* to fix and couple the elastic support means 17 to the magnetic circuit 11. In this case, since the coupling recess 15 and the coupling piece 17*a* of the present invention have the same width and thickness and an interval of a corresponding coupling recess 15*a* is less than that of a corresponding coupling piece 17*a*, the coupling piece 17*a* is tightly coupled with the coupling recess 15*a*. As a result, the elastic support means 17 may be welded to the magnetic circuit 11 in consideration of the stability without requiring a separate fixing operation.

In the present invention, since the elastic support means 17 is attached and coupled to a part of the magnetic circuit 11 through the coupling piece 17*a* instead of surrounding an entire circumferential outer surface thereof, an area of the magnetic circuit 11 may be increased by a deviant crease line part, that is, an area of the weight member 15 may be increased by way of example to increase a weight in an embodiment of the present invention.

Since the sensory signal output apparatus 10 of the present invention, in particular, a small sensory signal output apparatus is very light, it sensitively responds to given condition variation. Accordingly, the sensory signal output apparatus 10 sensitively responds to fine weight variation due to fine area variation in a vibrated part to obtain an output.

As illustrated previously, the weight is increased to increase mass acceleration and to improve vibrating force. Accordingly, the ratio of an output to the same input and the ratio of an output to that of another magnetic circuit 11 of the same diameter may be improved.

As illustrated earlier, in the present invention, the elastic support means 17 may be welded or adhered to an inner bottom of a case 1*a*. However, as shown in FIG. 9, the elastic support means 17 may be fixed and coupled to the case 1*a* by a rivet pin P1 penetrating a center of a fixing surface 17*a* of the elastic support means 17 and a bottom surface of the case 1*a*.

In the meantime, as shown in FIG. 10, a through hole may be formed at a central portion of the bottom surface of the case 1*a*, and an annular insertion protrusion 17*d* may be provided at a surface in a direction corresponding to a case 1*a* of the fixing surfaces 17*b* of the elastic support means 17. If doing this, the annular insertion protrusion 17*d* is tightly inserted into and fixed to the through hole of the case 1*a*. In this case, a front end of the annular insertion protrusion 17*d* may be bent or protrude in an outward direction and be then inserted and coupled into the through hole of the case 1*a*, making it possible not to be separated.

Although exemplary embodiments of the present invention have been described in detail hereinabove, it should be clearly understood that many variations and modifications of the basic inventive concepts herein taught which may appear to those skilled in the present art will still fall within the spirit and scope of the present invention, as defined in the appended claims.

What is claimed is:

1. A sensory signal output apparatus, comprising:

a magnetic circuit vibrating in response to an alternating signal flowing through a coil; and an elastic support means elastically supporting the magnetic circuit to surround the circumferential outer surface of the magnetic circuit from one side direction thereof, wherein coupling recesses are formed at the circumferential outer surface of the magnetic circuit to be spaced apart from each other, and a coupling piece is provided at a periphery of the elastic support means to be coupled to each of the coupling recesses, the coupling piece is attached to and inserted into the coupling recess.

2. The sensory signal output apparatus of claim 1, wherein the coupling recess and the coupling piece have the same width and thickness, and an interval of a corresponding coupling recess is less than that of a corresponding coupling piece, such that the coupling piece is inserted into and coupled to the coupling recess.

3. The sensory signal output apparatus of claim 1, wherein the magnetic circuit includes a magnet generating magnetic force;

a top plate disposed and fixed to an upper surface of the magnet;

a yoke including an annular protrusion formed in a through hole in a central portion thereof, inserted into and coupled to a circumferential outer surface of an end of the magnet, a side end of the annular protrusion extending and bent facing a circumferential outer surface of the magnet to form an aperture, and an end of the annular protrusion bent in a free space; and a weight member attached to and inserted into a circumferential outer surface of the yoke, the coupling recess being formed at a circumferential outer surface of the weight member, and an inner annular protrusion corresponding to the end of the yoke bent in the free space being formed at an inner diameter of an upper portion of the weight member.

4. The sensory signal output apparatus of claim 1, wherein the elastic support means is a plate spring that extends from an inner bottom surface of the case configuring an outward appearance of the sensory signal output apparatus to an open direction to have a horn shape, and the inclined extending surface thereof is cut, which applies elastic force.

5. The sensory signal output apparatus of claim 1, wherein the elastic support means includes a fixing surface provided at a central portion thereof; an elastic body formed by cutting and bending the inclined extend surface; and coupling pieces vertically protruding from a part of a circumferential outer surface of the elastic body to be spaced apart from each other by a predetermined distance and to be respectively inserted into the coupling recesses of the magnetic circuit.

6. The sensory signal output apparatus of claim 5, wherein each of the coupling pieces extends from an outer part in which the elastic body is located.

7. The sensory signal output apparatus of claim 5, wherein the coupling piece is vertically provided.

8. The sensory signal output apparatus of claim 5, wherein the coupling piece may be included in an inward direction of the elastic support means.

9. The sensory signal output apparatus of claim 5, wherein a front end of the coupling piece is bent inwards to further form a corresponding locking recess in the coupling recess of the magnetic circuit.

10. The sensory signal output apparatus of claim 5, wherein a central part of the coupling piece is bent inwards to further form a corresponding locking recess in a central part of the coupling recess.

11. The sensory signal output apparatus of claim 1, wherein the elastic support means is welded or adhered to an inner bottom surface of a case configuring an outward appearance of the sensory signal output apparatus.

12. The sensory signal output apparatus of claim 1, wherein the elastic support means is fixed and coupled to a case configuring an outward appearance of the sensory signal output apparatus by a rivet pin penetrating a center of a fixing surface of the elastic support means and a bottom surface of the case.

13. The sensory signal output apparatus of claim 1, wherein a through hole is formed at a central portion of a bottom surface of a case, and an annular insertion protrusion is provided at a surface in a direction corresponding to the case of the fixing surfaces of the elastic support means.

* * * * *